United States Patent [19]

Wrigley

[11] 3,980,157

[45] Sept. 14, 1976

[54] STOWING HINGE FOR BOAT LADDER

[75] Inventor: Robert A. Wrigley, Grosse Pointe Park, Mich.

[73] Assignee: Detroit Marine Engineering Corporation, Detroit, Mich.

[22] Filed: Sept. 22, 1975

[21] Appl. No.: 615,413

[52] U.S. Cl. ..... 182/163; 182/95; 182/97; 16/179

[51] Int. Cl.[2] ..... E06C 1/383; E06C 5/26

[58] Field of Search ..... 182/163, 164, 24, 91, 182/97, 95; 16/178, 179

[56] References Cited

UNITED STATES PATENTS

| | | | |
|---|---|---|---|
| 2,170,302 | 8/1939 | Hearn | 16/179 |
| 3,073,414 | 1/1963 | Lavrard | 182/24 |
| 3,848,699 | 11/1974 | Goodwin | 182/24 |
| 3,892,290 | 7/1975 | Lang | 182/163 |

*Primary Examiner*—Reinaldo P. Machado
*Attorney, Agent, or Firm*—Harness, Dickey & Pierce

[57] ABSTRACT

A hinge for a foldable boat ladder which permits the ladder to be stowed in its folded position without the need for additional fastening means. The hinge comprises a pair of sockets each having a plurality of leaves, the leaves interfitting. The leaves for the upper portion of the ladder have aligned holes carrying a stationary hinge pin. The leaves on the lower socket have inclined slots engaging this pin. In the lower hinge position the sockets are aligned. When the lower socket is swung upwardly 180°, its leaf slots slide downwardly and inwardly. The lower ends of these leaves engage the lower portion of the upper socket, and a bridge extending between the leaves above the pin engages a leaf on the upper socket. This prevents rattling and permits the sockets to be held firmly together, but still far enough apart so that steps on the upper and lower ladder portions may be aligned without touching.

5 Claims, 7 Drawing Figures

STOWING HINGE FOR BOAT LADDER

BACKGROUND OF THE INVENTION

1. Field of the Invention

The invention relates to boat ladders, and more particularly to stowable boat ladders mounted, for example, on the transom of a cabin cruiser. Such ladders are typically in two sections, the upper section being fixedly secured to the transom and the lower section movable between an extended position aligned with the upper section, and a folded position against the upper section.

In many instances, it is necessary to provide additional fastening means such as straps to hold the lower section of the ladder in its upper folded or stowed position. The invention pertains to stowing hinges which eliminate the need for these extra fastening means, the hinges themselves acting to hold the lower ladder section in its upper stowed position.

2. Description of the Prior Art

The closest known prior art is a stowing hinge manufactured by Investment Casting Division of Sealed Power Corporation, Waterville, Ohio. The hinge has upper and lower sockets, the upper socket having two leaves carrying a fixed hinge pin, the lower socket having a single leaf with a slot embracing this pin. In its lower position, the two sockets are offset, with one edge of the lower socket leaf engaging a vertical surface between the leaves of the upper socket. To move the ladder to its upper or stowed position, the lower socket must be swung upwardly 180° and then dropped vertically, the slot sliding downwardly on the pin with the other edge of the lower socket leaf engaging the surface between the upper socket leaves.

One disadvantage of this prior construction is that when the ladder is extended the sockets, and therefore the rails of the upper and lower ladder sections, are not aligned. Moreover, when the ladder is in its folded position, the two sections are so close together that it is necessary to arrange the steps so as to be offset. This may present dimensional design problems when constructing the ladder. This prior construction, by its inherent nature, also would not be, in many cases, sufficiently strong when fabricated of molded plastic material.

BRIEF SUMMARY OF THE INVENTION

It is an object of the present invention to provide a novel and improved stowable boat ladder hinge which overcomes deficiencies of prior constructions, and permits quick and easy stowing of a two-section ladder without the need for additional fastening means.

It is a further object to provide a stowable boat ladder hinge of this type which prevents rattling of the parts when in their stowed position.

It is another object to provide an improved hinge of this character which holds the boat ladder sections far enough apart in their stowed position as to permit the steps of the two sections to be aligned when stowed, thus permitting additional design flexibility when constructing a ladder.

It is a further object to provide an improved boat ladder stowing hinge of this nature which is inexpensive to construct, and is strong and reliable in use even when fabricated of plastic material.

Briefly, the stowable boat ladder hinge of this invention comprises upper and lower sections, each section having a rail support, the upper support having three spaced parallel leaves extending therefrom, the lower support having two spaced parallel leaves interfitting with the upper leaves, a pivot pin fixedly mounted on said upper leaves, slots in said lower leaves embracing said pin, said lower section being movable between an extended position in which said upper and lower supports are aligned and a folded position in which said supports are alongside each other, abutment means at the lower portion of said upper section between said upper leaves, the length of said lower leaves being such that when the lower section is swung to its folded position, said slots may be slid downwardly and inwardly on said pin until the lower portions of said lower leaves engage said abutment means on the upper section, and a bridge extending between the two leaves of said lower section, said bridge being above said pin and engaging a leaf of said upper section when the lower section is in its folded position.

DESCRIPTION OF THE PREFERRED EMBODIMENT

Figure 1:
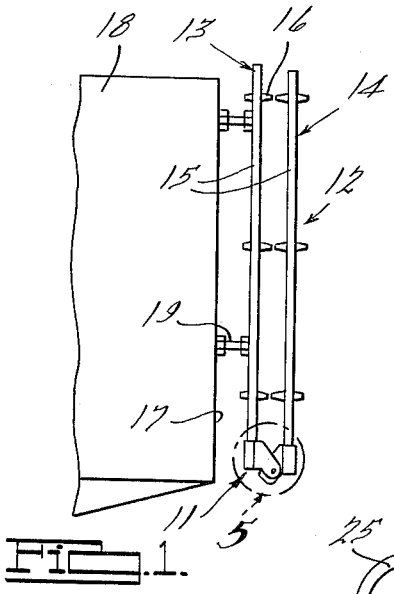
FIG. 1 is a side elevational view of the transom of a boat showing a ladder in its folded position with the hinge of this invention applied thereto.

The hinge of this invention is generally indicated at 11 and is adapted to be used in conjunction with a boat ladder generally indicated at 12. The boat ladder has two sections, an upper section generally indicated at 13 and a lower section generally indicated at 14. Each section has a pair of side rails 15 and steps 16. The side rails of upper section 13 are shown as being fixedly secured to the transom 17 of a boat partially indicated at 18 by securing members 19. Section 14 of the ladder is swingable with respect to fixed section 13 between an upper or folded position shown in FIG. 1 and a lower or extended position shown in FIG. 2. When in its folded position, the lower section 14 is closely alongside upper section 13 and steps 16 of the two sections are aligned. When in its extended position, section 14 is aligned with section 13 and the steps of the two sections are evenly spaced (FIG. 2).

Two hinges 11 are provided for the ladder. Each hinge has an upper section generally indicated at 21 and a lower section generally indicated at 22. These sections have tubular sockets 23 and 24 respectively for receiving and supporting rails 15 of their respective section. The bottoms of sockets 23 and 24 have circular raised portions 25 and 26 respectively which abut each other (FIG. 3) when lower section 14 of the ladder is in its extended position. The legends "TOP" and "BOTTOM" may be formed within these raised portions (FIG. 6) as an aid during assembly.

Figure 6:
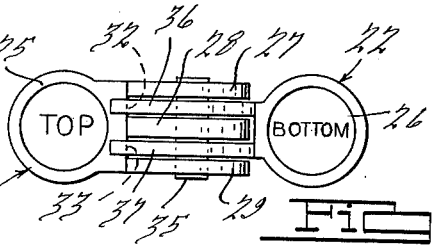
FIG. 6 is a bottom elevational view taken in the direction of the arrow 6 of FIG. 5.

Three leaves 27, 28 and 29 extend in spaced parallel relation from socket 23. These leaves are inclined downwardly and outwardly (FIG. 3) and their outer ends are curved as indicated at 31, the outer ends extending somewhat below the bottom of socket 23. Two abutments 32 and 33 are formed between the bases of these leaves, abutment 32 being disposed between leaves 27 and 28 and abutment 33 between leaves 28 and 29 (FIG. 6). The outer ends of the leaves are apertured as indicated at 34 for the reception of a hinge pin 35.

Two leaves 36 and 37 extend from socket 24. These leaves are formed similarly to leaves 27, 28 and 29 in that they are inclined outwardly and downwardly, that is, toward and somewhat past the bottom of socket 24. The portions of the outer ends of leaves 36 and 37 closer to socket 24 are rounded, as indicated at 38, whereas the end portions facing away from socket 24 are straight as indicated at 39 except for a small curvature 41. Slots 42 are formed in leaves 36 and 37 which embrace and are slidable on pin 35 when leaves 36 and 37 are disposed between leaves 27, 28 and 29.

Figure 4:
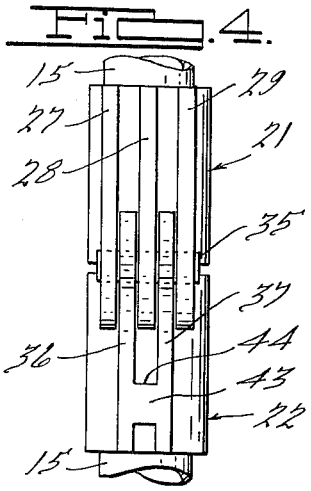
FIG. 4 is a view taken in the direction of the arrow 4 of FIG. 3.

A bridge 43 is formed between the intermediate portion of leaves 36 and 37, as seen best in FIG. 4. This bridge serves to strengthen the leaves which it connects, and also has a surface 44 which, when the hinge is in its folded position, abuts leaf 28.

Figure 3:
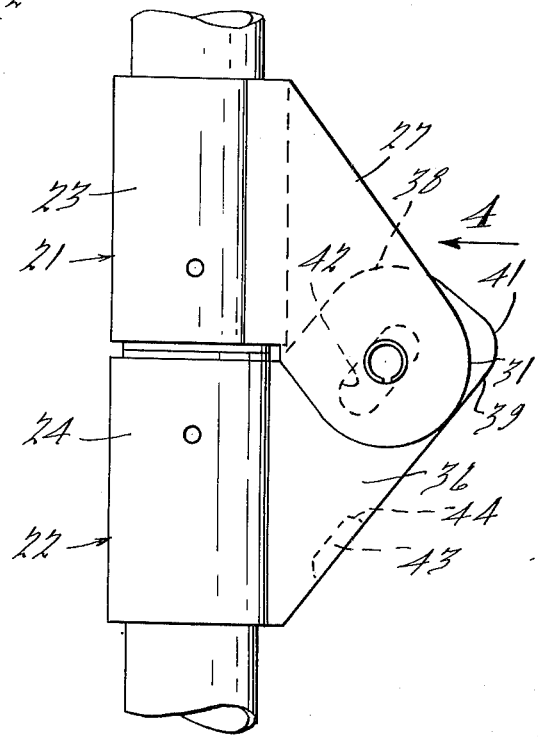
FIG. 3 is a view taken in the area marked 3 of FIG. 2 and showing the hinge of this invention.

In operation, when hinge 11 is in its extended position as seen in FIGS. 3 and 4, sockets 23 and 24 will be aligned. Raised surfaces 25 and 26, as well as the engagement of slot 42 with pin 35, will prevent swinging movement of lower section 22 in a clockwise direction in FIG. 3 beyond this aligned position. Therefore, a person standing on the steps of lower ladder section 14 will tend to hold this lower position in its extended position.

Figure 2:
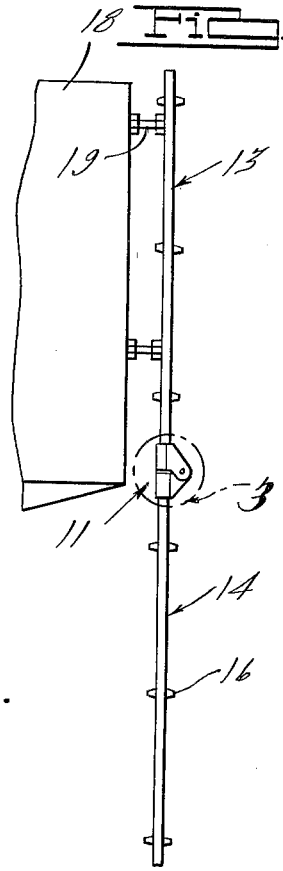
FIG. 2 is similar to FIG. 1 showing the ladder in its extended position.
Figure 5:
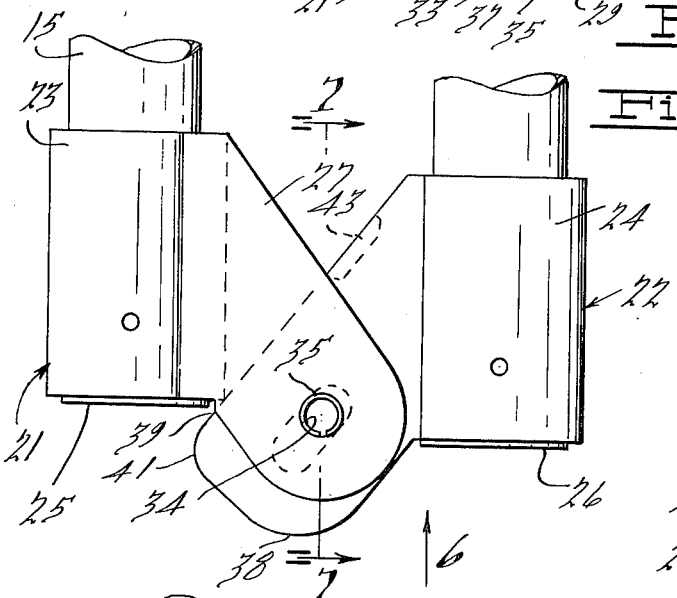
FIG. 5 is a view taken in the area marked 5 of FIG. 1 and showing the hinge in its folded position.
Figure 7:
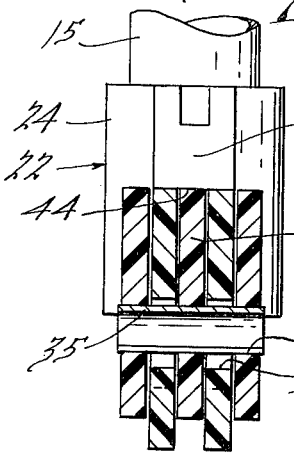
FIG. 7 is a cross-sectional view taken along the line 7—7 of FIG. 5.

When it is desired to stow lower section 14 in its folded position, the lower section will be swung counterclockwise in FIG. 2 toward the FIG. 1 position. As it reaches the FIG. 1 position, surfaces 39 of leaves 36 and 37 will move past abutments 32 and 33, permitting slots 42 to slide downwardly and to the left with respect to pin 35 (FIG. 5). This movement will continue until surface 44 of bridge 43 abuts leaf 28. In its final position, lower section 22 of the hinge will be prevented from both clockwise and counterclockwise movement, thus holding the lower section of the ladder in spaced parallel relation with the upper section. Clockwise movement of the lower section will be prevented by pin 35 and the engagement of surfaces 39 with abutments 32 and 33. Counterclockwise movement will be restricted by pin 35 and the engagement of bridge 43 with leaf 28. The ladder will thus be held securely, and in a manner which prevents rattling or shaking movement.

It should also be observed that the arrangement will maintain lower ladder section 14 a sufficient distance from upper section 13 as to prevent interference between the steps of the two ladder sections, despite the fact that these steps are aligned (FIG. 1).

Although the hinge of this invention may be made of various materials, it is particularly suitable for fabrication by molding of plastic material. This would include the integral formation of bridge 43 with leaves 36 and 37, performing a strengthening function in addition to its locking action.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A stowable boat ladder hinge comprising upper and lower sections, each section having a rail support, the upper support having at least one leaf extending therefrom, the lower support having two spaced parallel leaves interfitting with the upper leaf, pin-and-slot means connecting said upper and lower leaves, said lower section being movable between an extended position in which said upper and lower supports are aligned and a folded position in which said supports are alongside each other, abutment means at the lower portion of said upper section, the length of said lower leaves being such that when the lower section is swung to its folded position, said lower leaves may be slid downwardly and inwardly with respect to said upper section until the lower portions of said lower leaves engage said abutment means on the upper section to prevent unfolding of the ladder, and a bridge extending between the two leaves of said lower section, said bridge being above said pin-and-slot means and movable downwardly and inwardly during said sliding movement transversely to the extent of the leaf of said upper section when the lower section is in its folded position to engage the edge of said leaf, whereby further downward and inward movement of said folded lower section is prevented.

2. A boat ladder hinge according to claim 1, the outer ends of said lower leaves having a relatively large curvature on the portions facing the rail support and straight portions facing away from the rail support, the straight portions engaging said abutment means of the upper section when the hinge is in its folded position.

3. A boat ladder hinge according to claim 1, said upper and lower sections being formed of a molded plastic material with said bridge integral with the upper section leaves.

4. A boat ladder hinge according to claim 1, there being three spaced parallel leaves extending from said upper support, said abutment means being between said upper leaves.

5. A boat ladder hinge according to claim 4, said pin-and-slot means comprising a pivot pin fixedly mounted on said upper leaves and slots in said lower leaves embracing said pin.

* * * * *